US007244193B2

(12) United States Patent
Emalfarb

(10) Patent No.: US 7,244,193 B2
(45) Date of Patent: Jul. 17, 2007

(54) METHOD OF PLAYING GOLF

(76) Inventor: Bradley Emalfarb, 763 Bunker Ct., Riverwoods, IL (US) 60015

( * ) Notice: Subject to any disclaimer, the term of this patent is extended or adjusted under 35 U.S.C. 154(b) by 0 days.

(21) Appl. No.: 10/806,653

(22) Filed: Mar. 23, 2004

(65) Prior Publication Data

US 2004/0242345 A1 Dec. 2, 2004

Related U.S. Application Data

(63) Continuation-in-part of application No. 10/025,396, filed on Dec. 18, 2001.

(51) Int. Cl.
*A63B 37/00* (2006.01)

(52) U.S. Cl. ..... 473/351

(58) Field of Classification Search ..... 473/353, 473/351, 352, 375, 377, 378, 358
See application file for complete search history.

(56) References Cited

U.S. PATENT DOCUMENTS

| | | | |
|---|---|---|---|
| 5,098,104 | A | 3/1992 | Kane |
| 5,447,314 | A | 9/1995 | Yamazaki et al. |
| 5,823,891 | A | 10/1998 | Winskowicz |
| 5,938,544 | A | 8/1999 | Winskowicz |
| 5,948,848 | A | 9/1999 | Giltsoff |
| 6,011,466 | A | 1/2000 | Goldman |
| 6,113,504 | A | 9/2000 | Kuesters |
| 6,211,325 | B1 | 4/2001 | Sun et al. |
| 6,277,037 | B1 | 8/2001 | Winskowicz |
| 6,315,683 | B1 | 11/2001 | Yoshida et al. |
| 6,358,160 | B1 | 3/2002 | Winskowicz |
| 6,585,555 | B2 | 7/2003 | Wong et al. |
| 2002/0094885 | A1 | 7/2002 | Finkel |

*Primary Examiner*—Raeann Trimiew
(74) *Attorney, Agent, or Firm*—Wood, Phillips, Katz, Clark & Mortimer

(57) ABSTRACT

A method of playing golf including the steps of: obtaining a golf ball having a first state wherein the golf ball has a first performance characteristic and a second state resulting from immersion of the golf ball in water for a time period greater than two days and less than one hundred eighty days in which the golf ball has a second performance characteristic that is different than the first performance characteristic; striking the golf ball into an accumulation of water using a golf club; and allowing the golf ball to remain immersed in the accumulation of water for more than two days so that the golf ball is caused by the water to be changed from the first state into the second state in a time period less than one hundred eighty days.

6 Claims, 3 Drawing Sheets

METHOD OF PLAYING GOLF

CROSS REFERENCE

This application is a continuation-in-part of co-pending application Ser. No. 10/025,396 filed Dec. 18, 2001.

BACKGROUND OF THE INVENTION

1. Field of the Invention

This invention relates to balls used for playing golf and, more particularly, to a method of playing golf using a golf ball that has characteristics that change upon being exposed continuously to a liquid, such as water, for a predetermined time period.

2. Background Art

The game of golf is enjoyed by persons in large numbers on a worldwide basis. A key source of revenue to golf equipment suppliers is the ball used to play golf. Golfers, and particularly golfers of average or lesser talent, commonly lose a significant number of balls in woods, water holes and elsewhere during a round. While clubs and other accessories may be purchased only once, or a limited number of times, during an individual's playing career, supplies of golf balls must be regularly replenished.

It is a common practice of golf facilities to recover golf balls that have been retrieved from water holes, woods, or other hazards, and to sell these secondhand balls for reuse. This practice significantly reduces the demand for new golf balls, potentially representing millions of dollars in lost sales for golf ball manufacturers.

More significantly, use of secondhand golf balls may adversely affect the reputation of golf ball manufacturers. Used golf balls may be marred or otherwise disfigured upon being struck improperly by a club and/or upon encountering a hard object during play in normal use. Further, the characteristics of a golf ball may be altered as a result of being submerged in water holes for extended periods. After extended submersion, certain golf balls may actually absorb water, which changes their weight and playing characteristics. Golf balls may also deteriorate as a result of being immersed in moist dirt, sand, etc. An individual playing with an altered ball may attribute poor performance characteristics to the golf ball design, rather than to the fact that the golf ball's characteristics have been changed. A golfer may be induced to change brands as a result of experiencing poor performance with a particular type of used golf ball.

Aside from the fact that the reputation of a golf ball manufacturer may be adversely affected by modified, used golf balls, play with such balls may detract from the effectiveness of one's play, which may diminish interest in the sport. The financial loss to the golf industry is potentially huge.

SUMMARY OF THE INVENTION

In one form, the invention is directed to a method of playing golf. The method includes the steps of: obtaining a golf ball having a first state wherein the golf ball has a first performance characteristic and a second state resulting from immersion of the golf ball in water for a time period greater than two days and less than one hundred eighty days in which the golf ball has a second performance characteristic that is different than the first performance characteristic; striking the golf ball into an accumulation of water using a golf club; and allowing the golf ball to remain immersed in the accumulation of water for more than two days so that the golf ball is caused by the water to be changed from the first state into the second state in a time period less than one hundred eighty days.

The time period may be greater than two day and less than thirty days.

The step of allowing the golf ball to remain immersed in the accumulation of water may involve allowing the golf ball to remain immersed so that at least one of the shape, size, and hardness of the golf ball is changed as the golf ball is changed from the first state into the second state to the point that a user can detect a change from the first state into the second state by striking the golf ball.

The invention is further directed to a method of playing golf including the steps of: obtaining a golf ball having a first state wherein the golf ball has a first performance characteristic; placing the golf ball into an accumulation of water; and causing the golf ball to remain immersed in the accumulation of water and to change into a second state after a period of no less than two days and no more than one hundred eighty days in which second state the golf ball has a second performance characteristic that is detectably different than the first performance characteristic.

The method may further include the step of removing the golf ball from the accumulation of water after at least two days and determining that the golf ball has changed into the second state.

In one form, the step of determining that the golf ball has changed into the second state involves striking the golf ball with a golf club and observing the performance characteristics of the golf ball.

The step of placing the golf ball into an accumulation of water may involve striking the golf ball into the accumulation of water using a golf club.

DETAILED DESCRIPTION OF THE DRAWINGS

Figure 1:
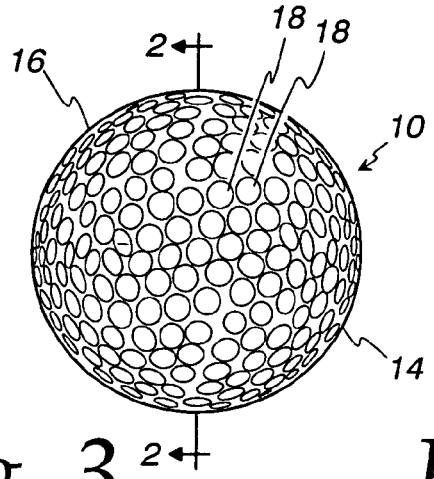
Fig. 1 (prior art)
FIG. 1 is an elevation view of a conventional golf ball.
Figure 2:
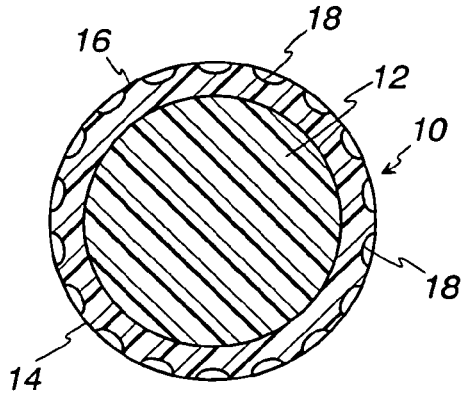
Fig. 2 (prior art)
FIG. 2 is a cross-sectional view of the golf ball taken along lines 2—2 of FIG. 1.

In FIGS. 1 and 2, a conventional golf ball is shown at 10. The golf ball 10 is shown strictly as an exemplary construction of a type within which the present invention can be incorporated. The golf ball 10 consists of a core 12 which is surrounded by a cover layer 14 defining a spherical outer surface 16 within which dimples 18 are formed. As noted above, the construction of the golf ball 10 is only exemplary of the myriad different designs that are currently used to play golf. As an example, the core 12 may vary significantly in terms of its diameter and composition, and may be made from a number of different layers or components.

A multitude of different core designs are currently used in the industry, with many more being researched. The core construction is not key to certain embodiments described herein. The material of the core shown in the various embodiments should not be viewed as limiting. The cover layer 14 may have a variety of different thicknesses and may be made from materials currently used to achieve desired durability and other desired performance characteristics. The dimples 18 shown are currently offered in different sizes, depth, shapes, densities, patterns, etc. over the outer surface 16. Typically, the cover layer 14, defining the spherical outer surface 16, is made from a material that is resistant to water permeation so that the golf ball 10 may be immersed in water for potentially a year or more without any significant alteration in the performance characteristic of the golf ball 10.

Figure 3:
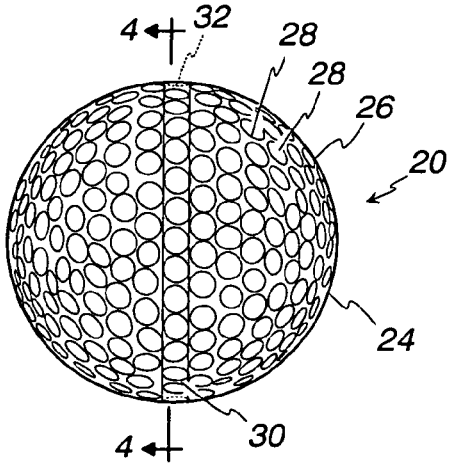
FIG. 3 is an elevation of one form of golf ball, according to the present invention, and incorporating a band of material in a cover layer thereon that is controllably degradable in water.
Figure 4:
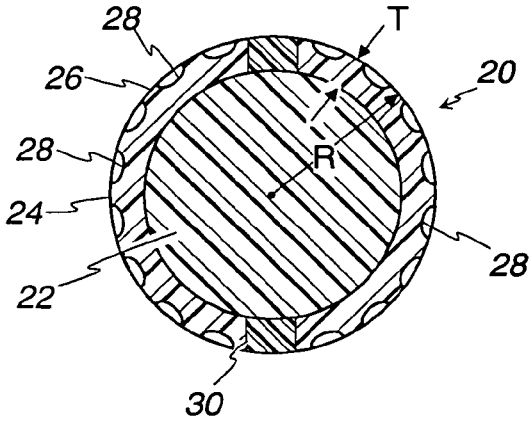
FIG. 4 is a cross-sectional view of the golf ball taken along the line 4—4 of FIG. 3.

One form of the invention is shown in FIGS. 3 and 4. The golf ball 20 in those figures is shown to have the same construction as the golf ball 10 in FIGS. 1 and 2. That is, the golf ball 20 has a body with a core 22 with a surrounding cover layer 24 defining a spherical outer surface 26 with dimples 28 formed therein. Typically, the cover layer 24 has a radial dimension, i. e., thickness T, that is substantially less than the radial dimension R of the outer surface 26. As an example, the thickness T may be no more than one-third the dimension R.

It is contemplated that the invention be used in the same manner with golf balls that are not perfectly round, i.e. elliptical or otherwise. Golf ball technology is developing at a rapid rate and it is conceivable that other than perfectly round shapes will be developed with improved aerodynamic characteristics. The description "spherical", as used herein, is intended to encompass golf balls that are both perfectly round and those that are not.

In this embodiment, a portion 30 of the cover layer 24 is defined by a material that is different than the material defining the remainder of the cover layer 24. In this embodiment the portion 30 is shown as a band extending continuously around the circumference of the golf ball 20. In this embodiment, the portion 30 extends fully through the thickness T of the cover layer 24.

According to the invention, the material defining the portion 30 is designed so that at least one of its shape, size and hardness is changed as an incident of being immersed in water for a period less than one hundred eighty days and as short as 2–3 days. This change may be such that the material flakes, chips, cracks, dissolves, or otherwise degrades or loses durability in a manner that the performance characteristics of the golf ball are noticeably altered. As one example of degradation, the material may melt under these conditions so that the exposed surface 32 of the material defining the portion 30 has a reduced diameter. As a result, the golf ball 20 has a changed shape such that it has a different performance characteristic than it has with the material in its original unmelted state. Consequently, once the material melts to a significant degree, the golf ball 20 may not be practically usable to play golf with or will be noticeably compromised in terms of its performance.

In actuality, the golf ball may be partially or fully immersed in damp soil as in a wooded area, in moist sand, in clear water, or in water with mud, silt, and organic growth therein. For purposes of this application, all of those conditions will be characterized as "immersion in water" or "being in the presence of water".

The nature of the material that changes shape and/or hardness may vary considerably. There currently exists in the area of polymer plastics knowledge of materials and manufacturing methods to produce a material with characteristics suitable for incorporation into a golf ball and which are changeable in the presence of water over a delayed/controlled time period. This type of material will be referred to as "degradable" below. As one example, plastics of this type are shown in U.S. Pat. No. 6,211,325, to Sun et al., which patent is incorporated herein by reference.

Generally, the material defining the portion 30 may be a resin-based material mixed with an additive. The additive amount is controllable to select the length of exposure to moisture, at which appreciable degradation occurs. The additive may be a starch-based degradable additive in an amount of 1–35%. Those skilled in the art will know how, and in what concentration, the additive should be mixed with the base resin to control degradation characteristics. A typical working range for the additive is 5–10%. The additive will typically be mixed in powder form with the resin. Of course, the components could be in any form, such as liquid or pellet form.

It is desirable that the hardness and/or dimension of the material change by immersion in water significantly within an immersion time period of less than one hundred eighty days, and more preferably one hundred twenty days. It may be more preferable to reduce this time period to thirty days, seven days, or even a matter of two or three days to avoid the possibility that golf course management might on a frequent basis recover golf balls from hazards for purposes of resale. It is of course important that the golf ball not have detectably deteriorated properties and performance characteristics upon being exposed to water in the normal course of play, i. e., in rainy conditions or upon being only briefly immersed in a water hole and recovered during a round. Thus, the performance characteristics preferably do not change with continuous immersion up to two days (48 hours).

Figure 5:
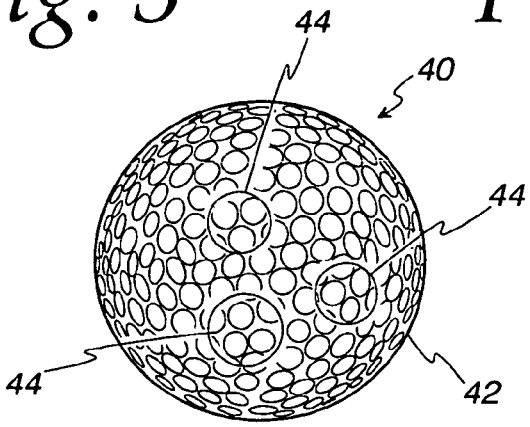
FIG. 5 is an elevation view of a modified form of golf ball, according to the present invention, and disclosing discrete portions of degradable material in a cover layer thereon.

In FIG. 5, a golf ball is shown at 40 having the same general construction as the golf balls 10, 20, with the exception that the degradable material is incorporated into the outer surface 42 thereof in discrete masses 44, in this case shown to be circular in shape.

Figure 6:
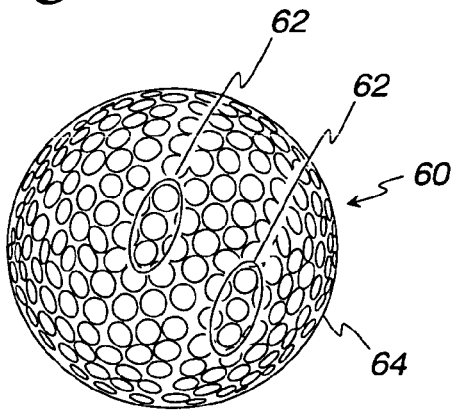
FIG. 6 is a view as in FIG. 5 showing different shapes of discrete portions of the degradable material contemplated by the invention.

In FIG. 6, a golf ball is shown at 60 of a construction similar to the golf ball 40, with the exception that the degradable material is incorporated in discrete portions 62 of an outer surface 64 and with the portions 62 taking an oval or elliptical shape.

Figure 7:
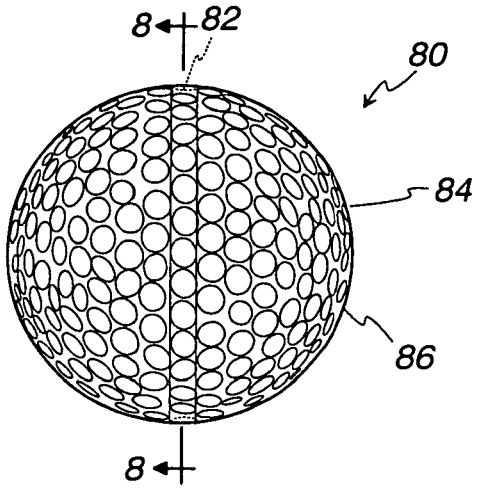
FIG. 7 is an elevation view of a further modified form of golf ball, according to the present invention, wherein degradable material is incorporated into the cover layer through less than the entire thickness thereof.
Figure 8:
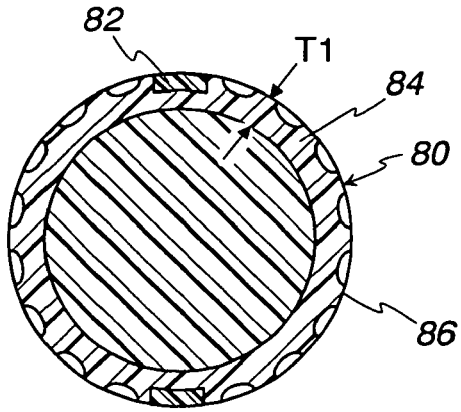
FIG. 8 is a cross-sectional view of the golf ball taken along lines 8—8 of FIG. 7.

In FIGS. 7 and 8, a golf ball 80 is shown having a construction similar to the golf ball 20, with the exception that the portion 82 defined by the degradable material is formed in a band which does not extend through the full thickness T. of the cover layer 84 defining an outer surface 86.

Figure 9:
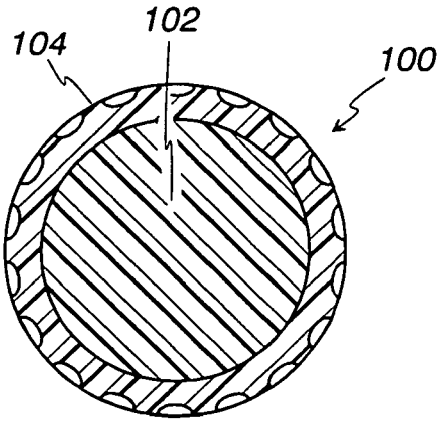
FIG. 9 is a cross-sectional view of a further modified form of golf ball, according to the present invention, wherein the entire cover layer is made from a material that is controllably degradable.

In FIG. 9, a golf ball is shown at 100 having a body and a core 102 and cover layer 104, with the cover layer 104 made entirely of the material which changes within the desired time period.

Figure 10:
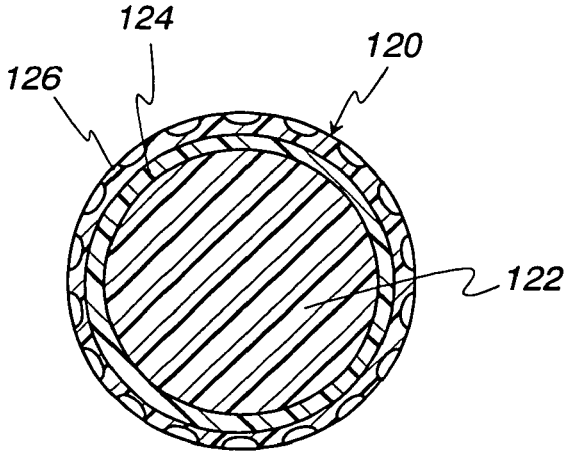
FIG. 10 is a cross-sectional view of a further modified form of golf ball, according to the present invention, including multiple cover layers.

In FIG. 10, a further modification is shown for a golf ball 120 having a body with a core 122, a surrounding layer 124 and a cover layer 126 surrounding the layer 124. Only the cover layer 126 is made from the material that degrades in water to the extent desired in the desired time period.

Of course, the entire golf ball can be formed as a solid mass made from the degradable material.

Figure 12:
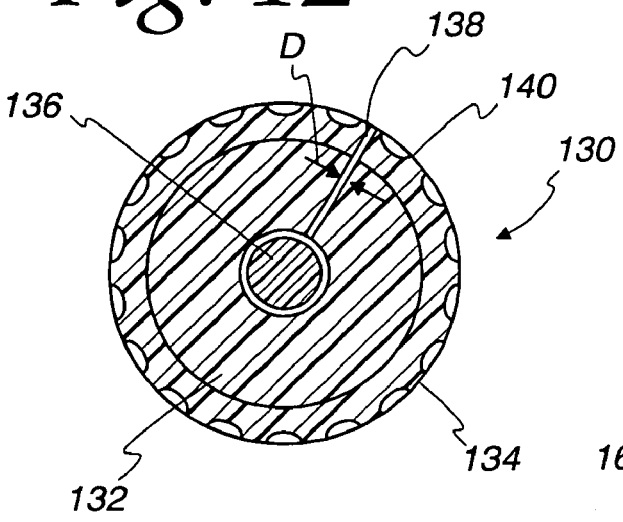
FIG. 12 is a cross-sectional view of a further modified form of golf ball, according to the present invention, wherein moisture migrates through a capillary to a part of the core that is degradable in the presence of moisture.

A further modified form of golf ball, according to the present invention, is shown at FIG. 12 at 130. The golf ball 130 has a body with a core 132 and a cover layer 134 surrounding the core 132. The core 132 has a central portion 136 that is made from a material that is degradable in the presence of moisture. A capillary 138 communicates from an external surface 140 of the cover layer 134 to the central portion 136 of the core 132. The capillary 138 has a diameter D chosen so that with the golf ball 130 immersed in a liquid, the time for the liquid to migrate fully to the central portion 136 can be controlled to be within the desired range, previously described, i.e. less than one hundred eighty days.

Figure 13:
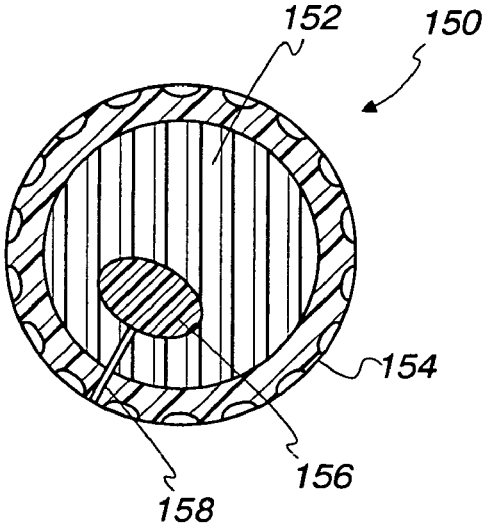
FIG. 13 is a cross-sectional view of a golf ball, according to the invention and as in FIG. 12, with a core part, to which moisture can migrate, having a different shape and location.

In FIG. 13, a modified form of golf ball, according to the present invention, is shown at 150. The golf ball 150 is of similar construction to the golf ball 130, having a body with a core 152, a cover layer 154 surrounding the core 152, a central core portion 156, and a capillary 158 communicating to the central core portion 156. This embodiment differs primarily in the shape and location of the central core portion 156. Whereas in the prior embodiment the core portion 136 has a generally centered location, the core portion 156 is set outwardly from the center location. Additionally, whereas the core portion 136 is shown with a round shape, the core portion 156 has an elliptical shape.

The core portions can have virtually any shape and location. Multiple core portions could be incorporated with a like number of capillaries. Further, multiple capillaries could be used to communicate with each core portion or multiple core portions.

Figure 14:
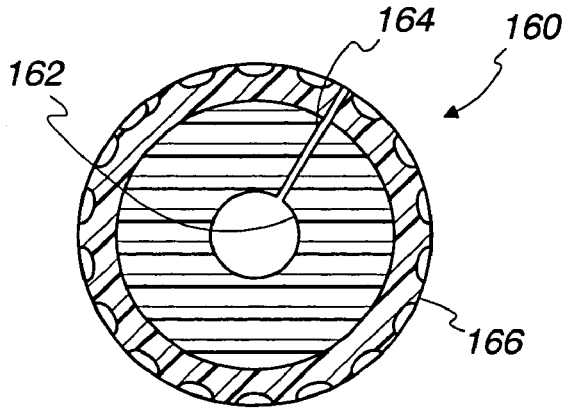
FIG. 14 is a cross-sectional view of a modified form of golf ball, according to the present invention, and utilizing a capillary through which moisture migrates to a hollow space in the core.

In FIG. 14, a further modified form of golf ball, according to the present invention, is shown at 160. The golf ball 160 is similar to the golf ball 130, show in FIG. 12, with the exception that a central core portion 162 is hollow. Moisture migrating through a capillary 164 from the external surface 166 communicates to the hollow core portion 162 and is accumulated thereat to thereby noticeably alter the playing characteristics of the ball 160.

Figure 15:
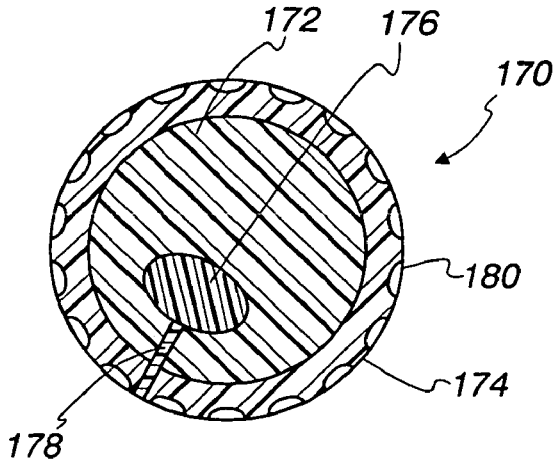
FIG. 15 is a cross-sectional view of a still further modified form of golf ball, according to the present invention, and utilizing a capillary that has a degradable material therein.

In FIG. 15, a further modified form of golf ball, according to the present invention, is shown at 170. The golf ball 170 has a body with a core 172 surrounded by a cover layer 174. The core 172 includes a core portion 176 that is made from a degradable material. A capillary 178 communicates from an external surface 180 of the cover layer 174 to the core part 176. The capillary 178 is filled with a degradable material 182. Accordingly, the effective diameter of the capillary 178, the material therein, and the length of the capillary 178 can be controlled, together with the characteristics of the material in the core part 176, to select the "useful life" of the golf ball 170.

Figure 11:
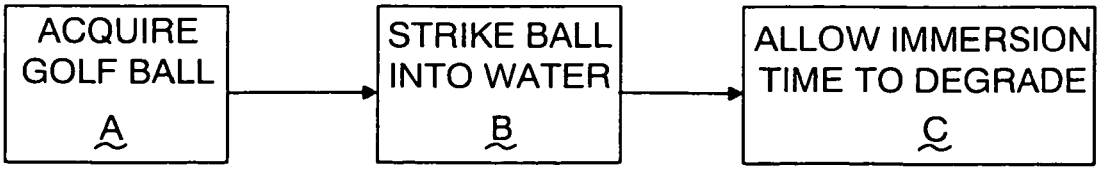
FIG. 11 is a schematic representation of a method of playing golf, using a golf ball according to the present invention.

As shown schematically in FIG. 11, using golf balls, made according to the present invention, a user can obtain/acquire a golf ball as indicated by the block A, strike the ball with a club into water, as shown at the block B, and allow the immersed ball to remain in the water for a sufficient length of time that the material defining part or all of the cover layer thereof, and/or an internal part of the golf ball, degrades to the point that the performance characteristics of the golf ball are compromised, as shown at the block C. Preferably, the golf ball will not degrade upon being immersed in water continuously for a period of up to two days (48 hours). That is, within the two day period there is no detectable change to the performance characteristics of the golf ball by reason of its continuous immersion. If recovered within the two days, the golf ball can be used in normal manner without any detectable compromise in performance determinable by a user by striking the golf ball.

It is desirable that the detectable degradation occur with continuous immersion before the time period reaches one hundred eighty days. This avoids recovery and re-use of golf balls that have been immersed, as during an entire off season, as in the Midwest climate regions, or during an entire season in this same region.

Preferably, the change in performance characteristics contemplated is such that it will be detectable to even an average golfer by striking the golf ball with a golf club.

The foregoing disclosure of specific embodiments is intended to be illustrative of the broad concepts comprehended by the invention.

The invention claimed is:

1. A method of playing golf, said method comprising the steps of:

obtaining a golf ball having a first state wherein the golf ball has a first performance characteristic and a second state, resulting from immersion of the golf ball in water for a time period greater than two days and less than one hundred eighty days, in which the golf ball has a second performance characteristic that is different than the first performance characteristic to an extent that it is impractical to use the golf ball with the second performance characteristic to play golf, the golf ball maintaining the first state while immersed in water up to the time period that is greater than two days but less than one hundred eighty days;

striking the golf ball into an accumulation of water using a golf club; and allowing the golf ball to remain immersed in the accumulation of water for the time period of more than two days and less than one hundred eighty days so that the golf ball is caused by the water to be changed from the first state into the second state only after immersion for the time period of at least two days and less than one hundred eighty days, wherein the golf ball in changing from the first state into the second state is caused to crack.

2. A method of playing golf, said method comprising the steps of:

obtaining a golf ball having a first state wherein the golf ball has a first performance characteristic and a second state, resulting from immersion of the golf ball in water for a time period greater than two days and less than one hundred eighty days, in which the golf ball has a second performance characterisic that is different than the first performance characteristic to an extent that it is impractical to use the golf ball with the immersed in water up to the time period that is greater than two days but less than one hundred eighty days;

striking the golf ball into an accumlation of water using a golf club; and allowing the golf ball to remain immersed in the accumlation of water for the time period of more than two days and less than one hundred eighty days so that the golf ball is caused by the water to be changed from the first state into the second state only after immersion for the time period of at least two days and less than one hundred eighty days, wherein the golf ball in changing from the first state into the second state is caused to flake or chip.

3. A method of playing golf, said method comprising the steps of:

obtaining a golf ball having a first state wherein the golf ball has a first performance characteristic and a second state, resulting from immersion of the golf ball in water for a time period greater than two days and less than one hundred eighty days, in which the golf ball has a second performance charateristic that is different than the first perfomance characteristic to an extent that is impractical to use the golf ball with the second performance characteristic to play gold, the golf ball maintaining the first state while immersed in water up to the time period that is greater than two days but less than one hundred eighty days;

striking the golf ball into an accumulation of water using a gold club; and allowing the golf ball to remain immersed in the accumulation of water for the time period of more than two days and less than one hundred eighty days so that the golf ball is caused by the water to be changed from the first state into the second state only after immersion for the time period of at least two days and less than one hundred eighty days, wherein the golf ball in changing from the first state into the second state is caused to at least partially dissolve.

4. A method of playing golf, comprising the steps of:

obtaining a golf ball having a first state wherein the golf ball has a first performance characteristic;

placing the golf ball into an accumulation of water; and causing the golf ball to remain immersed in the accumulation of water and to change into a second state after a period of no less than two days and less than one hundred eighty days in which second state the golf ball has a second performance characteristic that is detectably different to a golfer than the first performace characteristic by striking the golf ball with a golf club to an extent that it is impractical to use the golf ball with the second performance characteristic to play golf, the golf ball maintaining the first state while immersed in water up to the time period that is greater than two days but less than one hundred eighty days, wherein the golf ball in changing from the first state into the second state is caused to crack.

5. A method of playing golf, comprising the steps of:

obtaining a golf ball having a first state wherein the golf ball has a first performance characteristic;

placing the golf ball into an accumulation of water; and causing the golf ball to remain immersed in the accumulation of water and to change into a second state after a period of no less than two days and less than one hundred eighty days in which second state the golf ball has a second performance characteristic that is detectably different to a golfer than the first performance characteristic by striking the golf ball with a golf club to an extent that it is impractical to use the golf ball with the second performance characteristic to play golf, the golf ball maintaining the first state while immersed in water up to the time period that is greater than two days but less than one hundred eighty days, wherein the golf ball in changing from the first state into the second state is caused to flake or chip.

6. A method of playing golf, comprising the steps of:

obtaining a golf ball having a first state wherein the golf ball has a first performance characteristic;

placing the golf ball into an accumulation of water; and causing the golf ball to remain immersed in the accumulation of water and to change into a second state after a period of no less than two days and less than one hundred eighty days in which second state the golf ball has a second performance characteristic that is detectably different to a golfer than the first performance characteristic by striking the golf ball with a golf club to an extent that it is impractical to use the golf ball with the second performance characteristic to play golf, the golf ball maintaining the first state while immersed in water up to the time period that is greater than two days but less than one hundred eighty days, wherein the golf ball in changing from the first state into the second state is caused to at least partially dissolve.

* * * * *

UNITED STATES PATENT AND TRADEMARK OFFICE

CERTIFICATE OF CORRECTION

PATENT NO. : 7,244,193 B2
APPLICATION NO. : 10/806653
DATED : July 17, 2007
INVENTOR(S) : Bradley Emalfarb It is certified that error appears in the above-identified patent and that said Letters Patent is hereby corrected as shown below:

Claim 2 - Col. 7, line 4 should read as follows:

is impractical to use the golf ball with the second performance characteristic to play golf, the golf ball maintaining the first state while immersed in Col. 7, line 28 “gold” should be --golf--.

Col. 7, line 33 “gold” should be --golf--.

Signed and Sealed this

Thirtieth Day of October, 2007

JON W. DUDAS
*Director of the United States Patent and Trademark Office*